United States Patent [19]

Horger

[11] Patent Number: 4,512,261

[45] Date of Patent: Apr. 23, 1985

[54] SELF-STEERING RAILWAY TRUCK

[75] Inventor: Oscar J. Horger, San Diego, Calif.

[73] Assignee: A. Stucki Company, Pittsburgh, Pa.

[21] Appl. No.: 429,004

[22] Filed: Sep. 30, 1982

Related U.S. Application Data

[63] Continuation of Ser. No. 390,220, Jun. 21, 1982, abandoned.

[51] Int. Cl.[3] ..... B61D 3/08; B61D 5/26; B61D 5/38

[52] U.S. Cl. ..... 105/167; 105/165; 105/182 R; 105/223

[58] Field of Search ..... 105/4 R, 165, 166, 167, 105/168, 169, 170, 176, 179, 182 R, 200, 222, 223, 224 R, 224 A, 224.1, 416, 453; 267/3

[56] References Cited

U.S. PATENT DOCUMENTS

| | | | |
|---|---|---|---|
| 1,096,367 | 5/1914 | Head | 105/224 R X |
| 2,045,039 | 6/1936 | Maley et al. | 105/224 R |
| 2,207,848 | 7/1940 | Barrows | 105/224.1 |
| 2,479,054 | 8/1949 | Barrows | 105/224 R |
| 2,756,688 | 7/1956 | Furrer | 105/4 R |
| 2,792,791 | 5/1957 | Kreissig | 105/416 |
| 2,908,233 | 10/1959 | Furrer | 105/453 |
| 2,941,482 | 6/1960 | Furrer | 105/224 R |
| 2,956,515 | 10/1960 | Lich | 105/4 R |
| 3,254,610 | 6/1966 | Roley | 105/179 |
| 3,302,589 | 2/1967 | Williams | 105/223 X |
| 3,517,620 | 6/1970 | Weber | 105/167 |
| 3,528,374 | 9/1970 | Wickens | 105/182 R |
| 3,948,188 | 4/1976 | Zehmder | 105/167 |
| 4,064,809 | 12/1977 | Mulcahy | 105/167 |
| 4,091,739 | 5/1978 | Theurer et al. | 105/224 R |
| 4,134,343 | 1/1979 | Jackson | 267/3 X |
| 4,136,620 | 6/1979 | Scheffel et al. | 105/168 |
| 4,151,801 | 5/1979 | Scheffel et al. | 105/168 |
| 4,166,611 | 9/1979 | Geers et al. | 267/3 |
| 4,170,179 | 10/1979 | Vogel | 105/176 X |
| 4,173,933 | 11/1979 | Kayserling | 105/200 |
| 4,202,276 | 5/1980 | Browne et al. | 105/165 |

FOREIGN PATENT DOCUMENTS

| | | | |
|---|---|---|---|
| 1401829 | 7/1975 | United Kingdom | 105/224 A |

*Primary Examiner*—Robert R. Song
*Assistant Examiner*—Howard Beltran
*Attorney, Agent, or Firm*—E. Wallace Breisch; J. Stewart Brams

[57] ABSTRACT

A railway truck having a suspension wherein pivotal suspension links are connected between the pedestal openings of a truck side frame and the bearing adaptor of the bearing received within the respective pedestal opening to suspend the side frame with respect to the bearing adaptor so as to permit limited relative lateral and longitudinal motion of the axle and wheel set with respect to the side frame.

13 Claims, 7 Drawing Figures

SELF-STEERING RAILWAY TRUCK

This application is a continuation of application Ser. No. 06/390,220 filed June 21, 1982 now abandoned.

BACKGROUND OF THE INVENTION

This invention concerns self-steering railway trucks wherein the wheel sets are able to assume a radial orientation with respect to the center of curvature of a curved track section being traversed thereby.

Conventional three-piece railway truck designs comprised of a pair of laterally spaced side frames and a bolster extending transversely therebetween have become the standard in many railway industry applications; however, in many conventional truck designs utilized in conjunction with conventional track layouts and wheel conics, the wheel sets may not track radially around curves but instead may tend to slide during negotation of track curves. Additional problems encountered with conventional trucks include the tendency for the wheel sets to traverse curves in a non-radial orientation and with much wheel flange-to-rail rubbing contact. Such rubbing contact and wheel sliding result in undesirably high wheel and rail wear, and the flange rubbing in particular may produce a tendency for the wheel to climb the rail and cause a derailment. In addition, improper wheel set tracking in curves may result in track misalignment.

Other related problems occur when conventional trucks traverse straight or tangent runs of track. For example, a rigid wheel-axis set, having conventional tapered conical wheels, when displaced laterally of the center line of a run of straight track, executes two simultaneous motions; first, the wheel set moves toward its equilibrium (centered) position under the influence of gravity, and secondly, the high side wheel, rolling on a larger diameter than the low side wheel, moves along the rail faster than its partner, causing the wheel set to yaw. Given the proper set of conditions, this motion may become a sustained harmonic oscillation known as hunting with the sinusoidal peaks being clipped by contact between the rail and the wheel flange.

When rigid wheel sets are coupled in a truck through the side frames, or rigid truck frames, the hunting tendency is transmitted to the truck and causes an oscillatory yawing motion of the truck about its center of rotation. Continuous or semi-continuous motion of this nature is transmitted to the car body which then yaws about its center of gravity, or about the center plate of its second truck if that truck is not hunting.

Railway rolling stock design has been evolving toward higher center of gravity cars, heavier loads and higher operating speeds, all of which have the potential to seriously aggravate the problems described hereinabove. These problems have been recognized in the prior art with the resultant development of a variety of self-steering railway truck designs which purport to allow the wheel sets to track without sliding and without undue flange rubbing during negotiation of curves, and with minimal adverse consequences resulting from hunting.

Considerable prior work has been done in the area of self-steering railway trucks; nevertheless, there has been no overwhelming commercial acceptance of any self-steering railway trucks heretofore even though a significant need exists in the industry. The apparent reasons for industry non-acceptance of prior self-steering trucks include their relatively complex designs with resultant operational and maintenance problems; inherent requirements for substantially new truck designs; the inability to readily retrofit and/or to conform to inherent space limitations; and limitations in designs which provide for steering but which, in turn, amplify the tendency of the railway car to hunt in unloaded conditions on straight track to an unacceptable degree or to a degree that control thereof is uneconomical or unfeasible.

SUMMARY OF THE INVENTION

The present invention includes in a self-steering railway truck a suspension system which frees the axles for steering around curves by isolating the side frames from the wheel sets by means of a pendulous swing link arrangement which suspends the side frames of the truck from the wheel sets. By virtue of this arrangement the hereinabove described problems of prior art trucks are overcome or, in the least, greatly alleviated. More specifically, the pendulous swing link arrangement of the present invention permits limited movement of an inherently self-steering wheel set with respect to the side frames in both the direction of the longitudinal extent of the side frame and laterally thereof in the direction of the wheel set axis. Thus, the wheel sets have two degrees of freedom with respect to the side frames and are able to steer through track curves in the optimal radial orientation. Furthermore, the longitudinal and lateral journal freedom of this invention, which is necessary to permit wheel set steering, is accomplished with extremely low levels of mechanical restraint provided by the primary elements of the suspension system.

In a truck constructed according to this invention independent wheel set hunting may still occur because of the increased longitudinal and lateral freedom of the individual wheel sets; however, the invention provides a sufficient lateral freedom to inherently reduce the lateral car body to wheel set coupling.

It is to be noted that although one of the principal uses for the invention herein is in three-piece freight truck designs, the invention is equally applicable to provide for simple and economical self-steering of wheel sets in other types of truck designs such as in transit trucks wherein the truck side frames may be inboard of the wheel sets and which may or may not have conventional truck holsters for supporting the car body.

Accordingly, it is one object of this invention to provide a suspension system for a self-steering railway truck which may be readily incorporated into existing truck designs.

Another object of this invention is to provide such a suspension system which is simple in design and operational without high lateral and longitudinal restraints between the bearing journals and side frame pedestals.

A further object of this invention is to provide such a suspension system which is readily adaptable within the system itself, or in conjunction with external structure, to control deleterious hunting responses.

Yet another object of the invention is to provide a railway truck suspension system in which suspension links provide the wheel sets with two degrees of freedom with respect to the truck body or side frames an in addition provide an inherent self centering capability for gravitationally urging the wheel sets to a neutral position within their range of available movement with respect to the truck body or side frames.

These and other objects and advantages of the present invention will become more readily apparent upon a reading of the following description with references to the accompanying drawings, in which.

Figure 3:
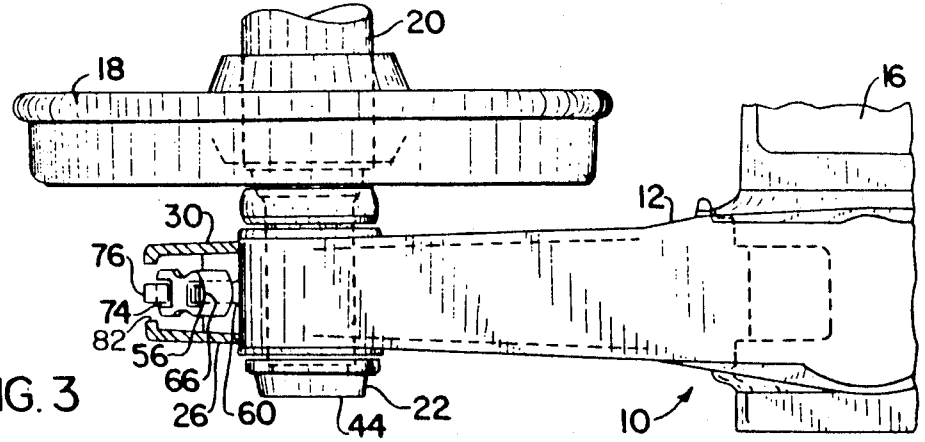
FIG. 3 is a top plan view, partially sectioned, taken on lines 3—3 of FIG. 1.
Figure 1:
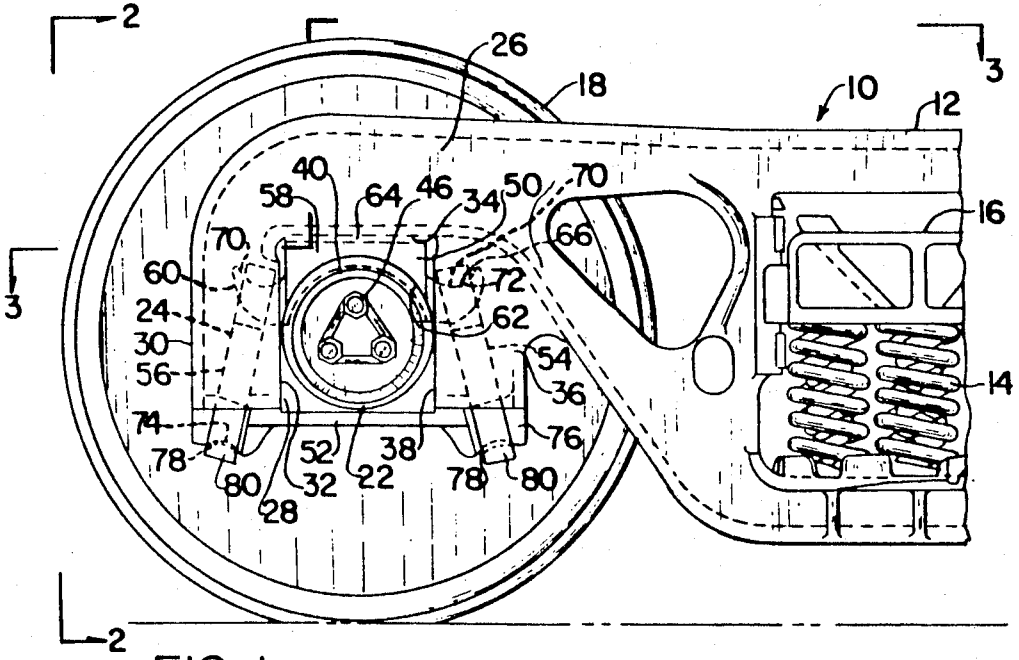
FIG. 1 is a side elevation of a portion of a three-piece railway truck incorporating one embodiment of the present invention.
Figure 2:
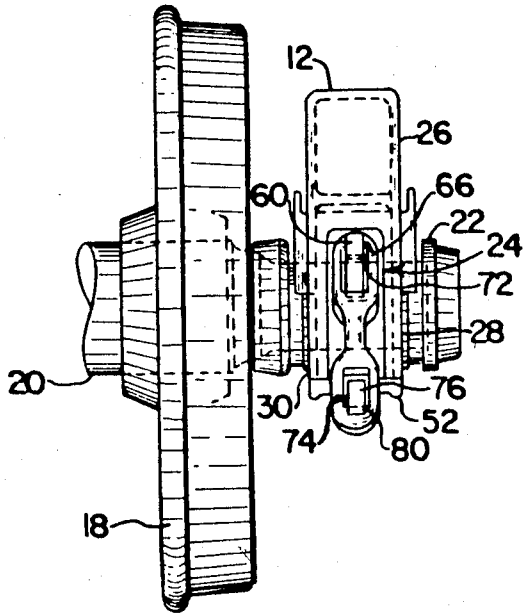
FIG. 2 is an end elevation taken on lines 2—2, of the truck of FIG. 1.

FIGS. 1, 2 and 3 illustrate a journal-pedestal portion of a four-wheel railway truck constructed in accordance with the principles of the present invention and generally indicated at 10. Truck 10 comprises a laterally spaced pair of side frames 12 (only a portion of one being shown) in which respective spring groups 14 are included intermediate the longitudinal ends thereof to support a bolster 16. Adjacent each end of side frames 12 is a wheel set comprising conic wheels 18 which are suitably fixed to live axles 20. The wheels sets are carried by side frames 12 through the use of known roller bearing assemblies 22 which cooperate with a suspension 24 of the present invention to support side frames 12 with respect to axles 20 in a manner to be described hereinafter in detail which permits limited movement of axles 20 with respect to the side frames 12.

Inasmuch as the invention herein is primarily directed to suspension 24, the other hereinabove described primary elements being well known in the art, further description of such other elements not believed necessary except insofar as may be otherwise necessary to describe the invention herein.

In FIG. 1 one end of side frame 12 is formed as a pedestal portion 26 which defines a downwardly open pedestal opening 28. Pedestal opening 28 is formed by: a vertically disposed, longitudinally outward pedestal jaw portion 30 having an inner peripheral surface 32, a pedestal roof portion 34; and a vertically disposed longitudinally inward pedestal jaw portion 36 having an inner peripheral surface 38.

A conventional roller bearing assembly 22 is carried adjacent each journal end of axles 20 and is retained within the confines of pedestal opening 28 in a manner to be described hereinbelow. Bearing assemblies 22 are secured by any suitable means as by a press fit for example on the journal end of axle 20. Each bearing assembly 22 is a sealed unit which includes a cylindrical roller bearing journal 40 mounted on a carrier that coaxially receives therewithin an inner cone and rollers (not shown). Bearing assemblies 22 are retained on axles 20 by axle end caps 44 secured with a plurality of cap screws 46.

Suspension 24 comprises: a bearing adapter 50 positioned intermediate the pedestal roof 34 and the adjacent portion of roller bearing journal 40; a retention member formed as a plate 52 which extends between the lowermost ends of pedestal jaw portions 30 and 36; and inward and outward swing link members 54 and 56, respectively, which engage and extend between generally vertically spaced retainer portions of bearing adapter 50 and member 52 as described hereinbelow.

Bearing adapter 50 comprises a main body portion 58 which is of a generally known design for bearing adapters and includes a downwardly, cylindrically concave surface 62 which seats upon an adjacent upwardly facing cylindrical surface of roller bearing journal 40 in the conventional manner. In the assembled configuration upper surface 64 of bearing adaptor main body portion 58 is spaced from the pedestal roof 34. Additionally, a longitudinal clearance is provided between the longitudinal ends of main body portion 58 and the respective adjacent pedestal jaw surfaces 32 and 38. In the embodiment of FIG. 1 such longitudinal clearance is necessary to provide for the longitudinal component of axle movement associated with the self-steering characteristics of the wheel sets.

As in known truck structures, side frames 12 are hollow. This feature is utilized in the embodiment of FIGS. 1–3 by disposing substantial portions of suspension 24 including link members 54 and 56 within the interior of pedestal jaw portions 36, 30. Specifically, an opening is formed in walls 32, 38 of pedestal jaw portions 30 and 36 to receive respective lug portions 60 formed adjacent the opposite longitudinal ends of bearing adaptor main body portion 58 such that in the assembled configuration lug portions 60 project into the interior of the respective pedestal jaw portions 30 and 36. Links 54 and 56 are formed as double ended eye bars and are located such that the top eye openings 66 thereof are seated on the respective lug portions 60 adjacent thereto. As shown, the links 54 and 56 extend downwardly and diverge outwardly with respect to the vertical axial plane of axle 20, and the lower eye openings 74 thereof are captively retained in cooperably formed seating portions 76 adjacent the respective longitudinal ends of retention member 52.

The lug portions 60 may be of any suitable configuration which will receive and captively seat the eye openings 66 in a manner that the links 54 and 56 are supported thereby with suitable contact geometry to permit links 54, 56 to swing in both the longitudinal and transverse directions. As illustrated, each lug portion 60 includes generally upwardly concave upper surface 70 which, in conjunction with the mating, downwardly facing surface 72 of eye opening 66, provides the requisite longitudinal and transverse freedom. Preferably, surface 70 presents a compound curvature which is upwardly concave in its longitudinal extent and upwardly convex in its lateral or transverse extent. The cooperably formed seating surface of eye opening 66 presents a complementary convex configuration in the longitudinal and lateral directions. Accordingly, each swing link 54, 56 is provided with two degrees of freedom for swinging motion both longitudinally of side frames 12 and laterally thereof or axially with respect to axles 20.

The elongated retention member 52 extends longitudinally between the lower ends of pedestal jaws 30, and the respective longitudinal end portions thereof are affixed to the respective lowermost surfaces of jaws 30 and 36 in any suitable manner, for example by bolts (not shown). In the assembled configuration the lower eye openings 74 of links 54, 56 are seated in the formed seating portion 76 of member 52 in a manner that the links 54 and 56 support member 52 and side frame 12. Each seating portion 76 presents a downwardly concave lower seating surface 78 which, in conjunction with a cooperably formed upwardly facing surface portion 80 of eye opening 74, provides suitable contact geometry for the requisite longitudinal and transverse freedom. The lower end retention of links 54, 56 by seating portions 76 preferably is provided by cooperable surfaces of compound curvature similar in all salient respects to the surfaces provided for engagement of eye openings 66 with lugs 60 as described hereinabove with respect to the retention of the upper ends of links 54, 56. Accordingly, rolling contact is achieved at all points of engagement for each of the links 54 and 56 to provide two degrees of freedom for small swinging motions both longitudinally and laterally with respect to side frames 12 in much the same manner as the connections between adjacent links in a link chain.

To facilitate assembly of the suspension 24 a lower portion of the longitudinal end of the side frame 12 includes a vertically extending slot 82 formed therewithin. Slot 82 permits the insertion of the eye openings 74 over the respective seating portions 76 prior to securing retention member 52 to pedestal jaws 30 and 36.

The inclusion of suspension 24 as described for each pedestal opening 28 provides a structure which permits sufficient lateral and longitudinal freedom of movement for each axle 20 to permit the axles 20 to track through curves on the optimum radial line position. Thus the wheel sets, which are inherently self-steering, track through the curves with minimal sliding and flange contact as compared to prior art truck designs having journals which are relatively rigidly engaged in the side frame pedestals.

As will be seen from FIG. 1, the side frame 12 is suspended at each end thereof from bearing adaptor 50 by a pair of links 54, 56 such that axles 20 are provided with two degrees of freedom for motion in a generally horizontal plane with respect to side frames 12. Accordingly, the side frames 12, bolster 16 and the car body carried thereby are all isolated or decoupled from the wheel sets whereby the mechanical restraint which would otherwise tend to impede self-steering of the wheel sets is minimized. If a longitudinally directed force couple is applied to side frame 12 and an axle 20, the axle 20 would move freely within predetermined limits with respect to side frame 12 by virtue of the link members 54 and 56 pivoting or swinging generally in a longitudinally extending vertical plane about the respective lug portions 60 and 76 in a manner that the lower ends of link members 54 and 56 would move longitudinally through an arc with respect to axle 20. A similar force couple applied in the lateral direction will permit a similar limited pivoting or swinging of links 54, 56 for movement of the side frame 12 with respect to the axles 20 in the transverse direction. The freedom of movement in the transverse direction acts in series with the lateral stiffness of the spring group 14 to reduce the lateral restraint or coupling between the car body and wheel sets. Thus, within predetermined limits, the side frames 12 are isolated and free to move with respect to the axles 20 and the wheel sets are free to respond to their inherent self-steering characteristics to the extent that the axles 20 are decoupled from the side frames by suspension 24. That is, the isolation of the axles 20 with respect to the side frames 12 will permit the self-steering wheel sets to adapt to the layout of the track by moving laterally of the track to roll on the optimum radius of each wheel 18, thus permitting axles 20 to assume a radial line when tracking through curves. The wheel sets therefore steer around curves with minimal tendency for sliding or breaking friction. In addition, the reduced car body to wheel set restraint, in combination with the shorter kinematic path of the independent wheel sets, can result in a higher frequency wheel set forcing input to a lower frequency car body to wheel set resonance thereby alleviating empty car hunting or tangent track over a higher useful speed range for freight cars.

An additional feature of the invention is that link members 54, 56 diverge downwardly and outwardly from the upper ends thereof to apply a gravitational centering bias whereby when the truck 10 leaves a curved section of track the wheel-rail cooperation urges the axles 20 toward a normal square alignment. The angle of divergence of links is 54, 56 is determined by a variety of factors (i.e., available clearances, retrofit or new side frame design, and the like); however, a preferable angle of each link with respect to a vertical plane is in the range of 10 to 50 degrees. The described centering bias is operative in both the transverse and longitudinal directions in that the swinging movements of links 54, 56 associated with all horizontal relative motion between side frames 12 and the wheel sets cause the side frames 12 to be lifted vertically with respect to the wheel sets. The gravitutional tendency to seek the lowest stable point of suspension accounts for the centering bias.

The invention herein permits the wheel sets of a railway truck to steer independently of each other. This independence, and the freedom of axles 20 to move, within predetermined limits, with respect to the side frames 12, may increase the propensity for hunting responses between the side frames 12 and axles 20 in certain circumstances. Such hunting responses may still occur in trucks with the suspension 24 in spite of the reduction in lateral restraint discussed hereinabove, depending on the particular structural and geometric limits to which the transverse axle freedom is reduced. In instances where track and operating conditions may result in hunting when utilizing the suspension of the present invention, other design features may be included to alleviate resultant hunting responses. Examples of such other features may include: the alternative embodiment of suspension 90 of this invention (see FIGS. 4–6); elastomeric means disposed intermediate plate 52 and the adjacent portion of pedestal jaws 30 and 36; and the like.

Figure 5:
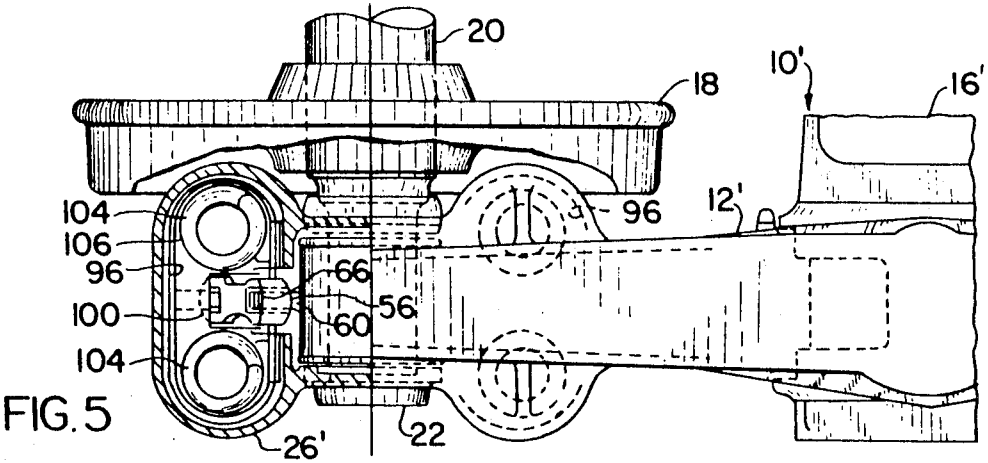
FIG. 5 is a plan view taken on lines 5—5 and partially in section, of the truck of FIG. 4.
Figure 4:
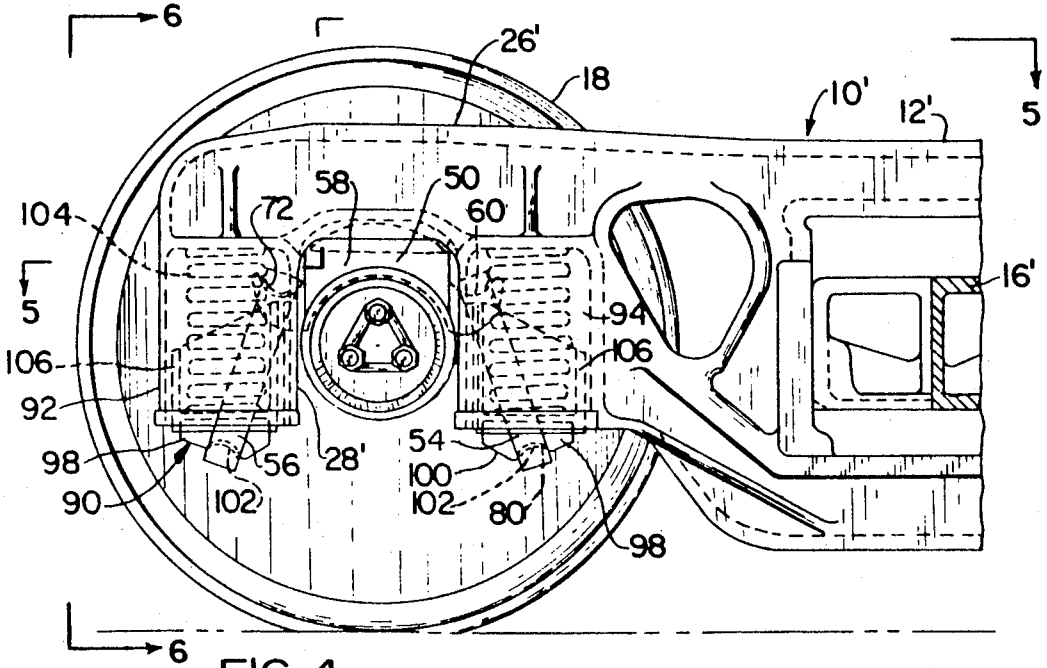
FIG. 4 is a side elevation of a portion of a three-piece railway truck incorporating another embodiment of the present invention.
Figure 6:
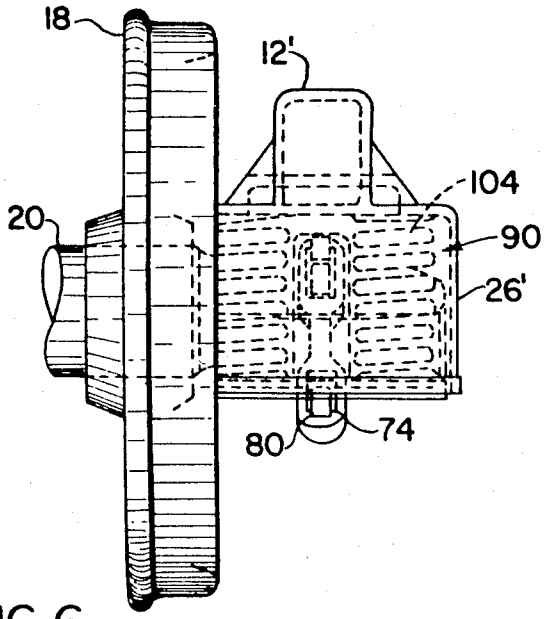
FIG. 6 is an end elevation taken on lines 6—6 of FIG. 4.

Referring now to FIGS. 4–6, suspension 90 is quite similar to suspension 24 described hereinbefore with the primary distinction therebetween being that suspension 90 is configured to be operational with a truck 10' of the type having a bolster 16' rigidly disposed with respect to side frames 12' with the suspension therefor being located in the vicinity of the pedestal opening 28'. Because of the similarity between suspension 90 and 24, elements of the embodiment of FIGS. 4–6 which are virtually identical to those of the embodiment of FIGS. 1–3 will be identified with identical reference numerals and elements which are similar will be identified with identical reference numerals primed. Furthermore, a detailed description of such identical and similar elements of the FIGS. 4–6 embodiment will not be set forth hereinbelow except as necessary to fully describe the suspension 90. Such detailed description may be found in the description hereinabove with reference to FIGS. 1–3.

In FIGS. 4–6, side frames 12′ of truck 10′ include enlarged transversely projecting outward and inward pedestal jaws 92 and 94, respectively, each of which has defined therewithin a downwardly open cavity or pocket 96. The suspension 90 includes a bearing adaptor 50; and a pair of swing links 54 and 56, respectively, which diverge downwardly within pockets 96 from the respective lug portions 60 of bearing adaptor 50 to engage individual retention members 98. The lower eye openings 74 of links 54, 56 are captively and pivotally retained by a central seating portion 100 of the respective retention member 98. Seating portion 100 includes a downwardly concave lower surface 102 which engages a cooperably formed upwardly facing surface portion 80 of eye opening 74 to provide the requisite longitudinal and transverse freedom of motion for the axles 20 with respect to side frames 12′. The specific geometry of the interengagement of links 54, 56 with lugs 60 and with seating portions 100 is similar in all respects to that described hereinabove with reference to FIGS. 1–3 and the resultant swinging capability of links 54, 56 including all perceived benefits and advantages thereof is likewise similar in all respects. Accordingly, further detailed description of such structure and its advantages is not repeated here.

Truck 10′ is provided with plural coil springs 104 at each longitudinal end of each side frame 12′. A pair of springs 104 is disposed within each pocket 96 laterally to either side of a respective one of links 54, 56. Springs 104 extend generally vertically intermediate the upper end of the respective pocket 96, where they engage side frame 12′ in supporting engagement, and a retention member 98. Accordingly, springs 104 provide the primary spring suspension for truck 10′ by supporting side frames 12′ with respect to retention members 98. In order to assure the retention of springs 104 within pockets 96 and proper operation thereof within pockets 96, each retention member 98 includes a generally tubular spring guide portion 106 which extends upwardly to encompass and retain the lower end of the respective spring 104. Accordingly, the lower end portion of each spring 104 is received within a respective guiding portion 106 for the captive and guiding retention thereof within the pocket 96. Suspension 90 is assembled by first positioning and holding bearing adapter 50 in the side frame pedestal opening 28′ and hanging link members 54 and 56 over the respective lug portions 60. Thereafter the lower eye openings 74 are secured to the respective central seating portions 100 of retention members 98 and the suspension 90 along with springs 104 and the side frame 12′ is lowered as a unit onto the journals of the wheel sets.

Suspension 90 operates in much the same manner as suspension 24 as described hereinabove. The primary distinction therebetween is that the springs 104 and spring guiding portions 106 cooperate to provide a vertical suspension damping as a result of an inward bias exerted by link members 54 and 56 on the guiding portions 106 which in turn results in friction contact between guide portions 106 and the adjacent interior wall of the respective pockets 96 when the springs 104 extend or compress.

The bearing adapter 50 thus has the same longitudinal and transverse freedom with respect to the side frame 12′ as in the embodiment first described hereinabove; however, it is to be noted that in the latter described embodiment a lateral space is shown between members 98 and guiding portions 106 thereof with respect to adjacent peripheral portions of the pocket 96 to accommodate said frame-to-journal lateral motion resulting from lateral spring deflection. Such lateral spring motion is in addition to the lateral pendulous swing of the supporting links 54 and 56.

Figure 7:
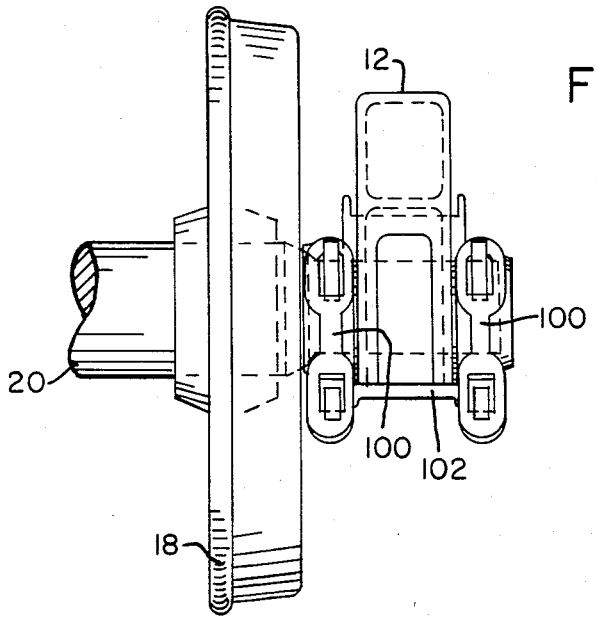
FIG. 7 is a fragmentary end elevation showing an alternative embodiment of the invention.

The embodiments described hereinabove are the presently preferred embodiments of the invention herein; however, it is to be understood that various modifications may be made thereto by those skilled in the art without departing from the scope of the invention which is defined by the claims set forth hereinafter. For example; springs 104 may be replaced or complemented by one or more hydraulic snubbers, if desired; the side frames may be modified by enlarging the pedestal opening such that the link members 54 and 56 are not received within the interior of the side frame; various attachments may be utilized in place of the link members 54 and 56 and supporting structure therefor so long as the pendulous support as described hereinabove is provided between the side frames 12 and axles 20; the concept of the invention is equally applicable for truck designs other than three piece freight truck designs, for example, transit trucks wherein the side frames may be inboard of the wheel sets and which may or may not have conventional truck bolsters for supporting the car body; and the like. A further modification (FIG. 7) which may be utilized in instances where a simple retrofit to existing side frames 12 is desired could include the utilization of a transversely spaced pair of link members 100 on each side of each journal adapter with the lower ends of each such link member being pivotally connected to a retention member 102 extending across the pedestal opening adjacent the lower end thereof. The top end of each such link member would be pivotally connected to respective bearing adapter means therefor. Such alternative suspension means would operate substantially identically to suspension 24; however, the only needed modification to the side frames would be adjacent the lower end of the pedestal opening and side frame modification would therefor be significantly simplified.

These and other embodiments and modifications having been envisioned and anticipated by the inventor; the invention should be construed as broadly as permitted by the scope of the claims appended hereto.

I claim:

1. A railway truck comprising:

a pair of laterally spaced, elongated side frame members having opposed openings therein intermediate the length thereof; respectively, at least one elongated rotatable axle extending transversely between said side frame members with the ends thereof being received at least in part within said openings, respectively;

rotatable wheels carried by said axle adjacent the ends thereof laterally inward of said side frame members, respectively;

said axle having axially spaced and circumferentially extending bearing areas located outwardly adjacent said wheels and said openings, respectively;

side frame support members engageable by upwardly facing portions of said bearing areas, respectively, for continuous support thereof;

each of said side frame support members carrying longitudinally spaced upper support means;

said upper support means including upwardly facing engagement surface portions which are fixedly located with respect to said side frame support members, respectively, generally outwardly in longitudinally opposite directions with respect to a vertical plane passing through the axis of rotation of said axle;

each of said side frame members carrying longitudinally spaced lower support means;

said lower support means including downwardly facing engagement surface portions which are fixedly located with respect to said side frame members, respectively, outwardly in opposite directions with respect to such a vertical plane;

said downwardly facing engagement surface portions being spaced a greater longitudinal distance from such vertical plane than the respective said upwardly facing engagement surface portions to provide a pair of longitudinally offset upper and lower engagement surface portions on each side of such vertical plane adjacent each end of said axle;

and rigid connecting means having fixedly spaced apart, oppositely facing surfaces thereon which are engageable with respective said pairs of upper and lower engagement surface portions to connect said upper and lower support means, respectively, in a manner to permit simultaneous relative lateral and longitudinal movement of said members in response to the relative lateral and longitudinal movement of said wheels and said axle with respect to said side frame members while maintaining continuous engagement with said upper and lower engagement surface portions.

2. A railway truck as specified in claim 1 wherein said relative lateral and longitudinal movement is sufficient to accommodate self steering by said railway truck.

3. A railway truck as specified in claim 1 wherein said upper and lower support means are integral with said side frame support members and said side frame members, respectively.

4. A railway truck as specified in claim 1 wherein said upwardly facing engagement surface portions are located above a horizontal plane passing through such axis of rotation and said downwardly facing engagement surface portions are located below such horizontal plane.

5. A railway truck as specified in claim 1 wherein said upwardly facing and said downwardly facing engagement surface portions are generally curvilinear surfaces.

6. A railway truck as specified in claim 1 wherein said upwardly facing engagement surface portions are maintained generally equidistant from such a vertical plane, and the respective said downwardly facing engagement surface portions are maintained generally equidistant from such a vertical plane.

7. A railway truck as specified in claim 1 wherein said rigid connecting means includes a plurality of rigid link members for engagement with each said pair of upper and lower engagement surface portions.

8. The railway truck as specified in claim 1 wherein each of said side frame members includes a pair of said openings spaced longitudinally thereof and said at least one axle is a pair of axles, each having the ends thereof received at least in part within said openings, respectively, in each said side frame member.

9. The railway truck as specified in claim 1 wherein said slideable support of said side frame support members by said bearing areas is support thereof for rotation within predetermined circumferential limits about the axis of rotation of said axle.

10. A railway truck as specified in claim 1 wherein each said rigid connecting means includes plural rigid connecting members and each said pair of upper and lower engagement surface portions is engageable by a single said rigid connecting member.

11. A railway truck as specified in claim 1 wherein each said rigid connecting means includes an elongated link member which engages a respective said pair of upper and lower engagement surface portions and diverges downwardly with respect to such a vertical plane.

12. A railway truck as specified in claim 11 wherein said link members diverge, with respect to such vertical plane, at an angle of 10 to 50 degrees.

13. A railway truck as specified in claim 11 wherein said link members diverge downwardly from such a vertical plane at substantially equal angles of divergence.

* * * * *